United States Patent [19]

Brady et al.

[11] Patent Number: 4,701,273

[45] Date of Patent: Oct. 20, 1987

[54] LUBRICANT COMPOSITIONS CONTAINING ANTIOXIDANTS, AMINE PHOSPHATES AND 4- (5-) METHYL-1-[DI-(2-ETHYLHEXYL) AMINOMETHYL]-BENZOTRIAZOLE

[75] Inventors: Arthur Brady, Magden; Ulrich Kristen, Rheinfelden; Hermann F. Angerer, Biel-Benken; Franz Regenass, Liestal, all of Switzerland

[73] Assignee: Ciba-Geigy Corporation, Ardsley, N.Y.

[21] Appl. No.: 906,627

[22] Filed: Sep. 10, 1986

Related U.S. Application Data

[63] Continuation of Ser. No. 682,630, Dec. 17, 1984, abandoned.

[30] Foreign Application Priority Data

Dec. 23, 1983 [CH] Switzerland ..... 6882/83

[51] Int. Cl.[4] ..... C10M 137/08

[52] U.S. Cl. ..... 252/32.5; 252/49.8; 252/49.9; 252/46.7; 252/47.5; 252/50

[58] Field of Search ..... 252/32.5, 49.8, 49.9, 252/50, 46.7

[56] References Cited

U.S. PATENT DOCUMENTS

| | | | |
|---|---|---|---|
| 3,697,427 | 10/1972 | Byford et al. | 252/49.9 |
| 3,914,179 | 10/1975 | Byford et al. | 252/49.9 |
| 3,931,022 | 1/1976 | Chesluk et al. | 252/49.9 |
| 4,101,431 | 7/1978 | Kuntschik | 252/49.9 |

OTHER PUBLICATIONS

Smalheer et al.; "Lubricant Additives"; 1967; p. 7.

*Primary Examiner*—Jacqueline V. Howard
*Attorney, Agent, or Firm*—Luther A. R. Hall

[57] ABSTRACT

Lubricant formulations containing a combination, which has a synergistic action in respect of metal deactivation, composed of 1-[di-(2-ethylhexyl)-aminomethyl]-benztriazole which is methylated in the benzene ring in the 4-position and/or 5-position, and an antioxidant selected from a small group of antioxidants. Further additives can be added to these lubricant formulations. The compositions mentioned above reduce the abrasion phenomena in the components to be lubricated if they are added to mineral and synthetic lubricating oils, hydraulic fluids and lubricating greases.

7 Claims, No Drawings

LUBRICANT COMPOSITIONS CONTAINING ANTIOXIDANTS, AMINE PHOSPHATES AND 4-(5-) METHYL-1-[DI-(2-ETHYLHEXYL) AMINOMETHYL]-BENZOTRIAZOLE

This is a continuation of application Ser. No. 682,630, filed on Dec. 17, 1984, now abandoned.

The present invention relates to stabiliser systems containing lubricant additives and to their use.

It is known that lubricants undergo change with time, entirely regardless of whether or not they are under stress. In order to cope with these changes and to meet the increased requirements in respect of the performance of lubricants, there are generally added to mineral and synthetic lubricating oils, hydraulic fluids and lubricating greases, various additives which improve, for example, the oxidation and corrosion behaviour of these lubricants; these also include, inter alia, metal deactivators which deactivate dissolved metal salts causing accelerated oxidation of lubricants, or form a protective film on the metal surface.

Benztriazole and derivatives thereof have already been known for some years as deactivators for non-ferrous metals, particularly for copper. They are added to lubricants and hydraulic fluids as additives. With regard to uses, there are, however, limitations arising from their low solubility in oil. Compounds which have a higher solubility in oil can be prepared by suitable substitution in the benzene ring. A further problem is compatibility with additional additives, for example amine phosphates, which can be used as multi-purpose additives in various stabiliser systems. Compositions which contain, as metal deactivators, benztriazole derivatives which have been obtained via a specific method of synthesis and purification and, as a result, have an improved effectiveness, are described and claimed in Japanese Published Application No. 58-52,393. It is also mentioned therein that these benztriazole derivatives can also function in combination with additional additives inter alia also antioxidants, the latter, however, not being mentioned specifically.

It has now been established that the combination of an antioxidant selected from a small group of quite specific antioxidants, and the compound 1-[di-(2-ethylhexyl)-aminomethyl]-benztriazole which is substituted by methyl in the 4-position and/or 5-position in the benzene ring exerts an unexpected synergistic effect in respect of metal deactivation in lubricants based on a mineral or synthetic lubricating oil, a hydraulic fluid or lubricating greases. It has also been found that the above benztriazole compound excellently fulfils the requirements to be set in respect of compatibility with additives of the amine phosphate type, which is not by any means self-evident in the case of other benztriazole derivatives.

The present invention relates to stabiliser systems containing 1-[di-(2-ethylhexyl)-aminomethyl]-benztriazole which is substituted in the 4-position and/or 5-position in the benzene ring by methyl, and at least one antioxidant selected from the group consisting of: pentaerythrityl tetrakis-[3-(3,5-di-tert.-butyl-4-hydroxyphenyl)-propionate], isooctyl 3,5-di-tert.-butyl-4-hydroxybenzylmercaptoacetate, o-tert.-butylphenol, 2,6-di-tert.-butyl-4-methylphenol, 4,4'-methylenebis-(2,6-di-tert.-butylphenol), tert.-octylated n-phenyl-1-naphthylamine or a mixture of monoalkylated and dialkylated tert.-butyl diphenylamines/tert.-octyl diphenylamines.

In this context isooctyl is to be understood as meaning a radical which is derived from isooctyl alcohol and is a mixture of different branched octyl radicals.

Tert.-octyl is to be understood as meaning 1,1,3,3-tetramethylbutyl.

Furthermore, additional additives which are preferred are the multi-purpose additives of the type

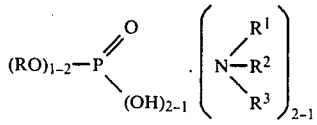

(I)

in which $R^1$, $R^2$ and $R^3$ are identical or different and $R^1$, $R^2$ and $R^3$ are each hydrogen or $C_1$–$C_{18}$-alkyl, $C_{16}$–$C_{18}$-alkenylmethyl, phenyl, naphthyl or $C_5$–$C_6$-cycloalkyl and R is $C_4$–$C_{12}$-alkyl.

As $C_1$–$C_{18}$-alkyl, $R^1$, $R^2$ and $R^3$ are preferably linear or branched $C_{10}$–$C_{18}$-alkyl, and as $C_{10}$–$C_{18}$-alkyl they are particularly preferentially tetramethylnonyl, branched $C_{11}$–$C_{14}$-alkyl or tetramethylundecyl.

As $C_{16}$–$C_{18}$-alkenylmethyl, $R^1$, $R^2$ and $R^3$ are preferably hexadecenyl or oleyl.

As $C_4$–$C_{12}$-alkyl, R is preferably a $C_4$–$C_8$-alkyl radical, in particular n-butyl, n-pentyl, n-hexyl, n-heptyl or n-octyl.

0.001–5% by weight of 1-[di-(2-ethylhexyl)-aminomethyl]-benztriazole which is substituted in the 4-position and/or 5-position in the benzene ring by methyl and 0.01–5.0% by weight of an antioxidant, based on the weight of the lubricant formulation, are added to the lubricant; it is preferable, however, to add 0.005–3.0% by weight of the benztriazole derivative and 0.05–2.0% by weight of an antioxidant, and it is particularly preferable to add 0.01–1.0% by weight of the benztriazole derivative and 0.1–2.0% by weight of an antioxidant. The ratio between the amount of benztriazole derivative employed to that of antioxidant is preferably within the range from 1:2 to 1:10.

The compounds of the formula I are employed in concentrations of 0.01–2.0% by weight, based on the total weight of lubricant formulation. The preferred range of concentrations is 0.05–1.0% by weight. These compounds are preferably added in a ratio of 1:0.5 to 1:4, based on the mixture of benztriazole derivative and antioxidant which is employed within the above range of ratios.

The preparation of 1-[di-(2-ethylhexyl)-aminoethyl]-benztriazole which is methylated in the benzene ring in the 4-position and/or 5-position is effected in a known manner from tolutriazole, formaldehyde and secondary amines, by means of the Mannich reaction. The phenolic and amine antioxidants which are to be used concomitantly in the stabiliser system are also known compounds and can be prepared by known processes or are available commercially, as are also the compounds of the formula I.

If mineral and synthetic lubricating oils, hydraulic fluids and lubricating greases are treated in this way, they display excellent lubricating properties which make themselves evident in greatly reduced abrasion phenomena in the components to be lubricated; this is due to the fact that the additives used in the stabiliser system increase the antioxidising and corrosion-resistant action, particularly the metal deactivating action, in the lubricants; they also improve the extreme-pressure behaviour and the effectiveness against wear.

The lubricants concerned are familiar to those skilled in the art and are described, for example, in "SchmiermittelTaschenbuch" ("Lubricants Handbook") (Hüthig Verlag, Heidelberg, 1974). Besides mineral oils, particularly suitable lubricants are, for example, poly-α-olefines, lubricants based on esters, phosphates, glycols, polyglycols and polyalkylene glycols.

In addition, the lubricant formulations can also contain other additives which are added in order to improve certain properties in use, for example further antioxidants, metal passivators, rust inhibitors, viscosity index improvers, pour-point depressants, dispersing agents/surfactants and anti-wear additives.

EXAMPLES OF PHENOLIC ANTIOXIDANTS

1. Alkylated monophenols 2,6-di-tert.-butylphenol, 2-tert.-butyl-4,6-dimethylphenyl, 2,6-di-tert.-butyl-4-ethylphenol, 2,6-di-tert.-butyl-4-n-butylphenol, 2,6-di-tert.-butyl-4-i-butylphenol, 2,6-di-cyclopentyl-4-methylphenol, 2-(α-methylcyclohexyl)-4,6-dimethylphenol, 2,6-di-octadecyl-4-methylphenol, 2,4,6-tri-cyclohexylphenol and 2,6-di-tert.-butyl-4-methoxymethylphenol.

2. Alkylated hydroquinones 2,6-Di-tert.-butyl-4-methoxyphenol, 2,5-di-tert.-butylhydroquinone, 2,5-di-tert.-amylhydroquinone and 2,6-diphenyl-4-octadecyloxyphenol.

3. Hydroxylated thiodiphenyl ethers 2,2'-Thiobis-(6-tert.-butyl-4-methylphenol), 2,2'-thiobis-(4-octylphenol), 4,4'-thiobis-(6-tert.-butyl-3-methylphenol) and 4,4'-thiobis-(6-tert.-butyl-2-methylphenol).

4. Alkylidene-bisphenols 2,2'-Methylenebis-(6-tert.-butyl-4-methylphenol), 2,2'-methylenebis-(6-tert.-butyl-4-ethylphenol), 2,2'-methylenebis-[4-methyl-6-(α-methylcyclohexyl)-phenol], 2,2'-methylenebis-(4-methyl-6-cyclohexylphenol) 2,2'-methylenebis-(6-nonyl-4-methylphenol), 2,2'-methylenebis-(4,6-di-tert.-butylphenol), 2,2'-ethylidenebis-(4,6-di-tert.-butylphenol), 2,2'-ethylidenebis-(6-tert.-butyl-4-isobutylphenol), 2,2'-methylenebis-[6-(α-methylbenzyl)-4-nonylphenol], 2,2'-methylenebis-[6-(α,α-dimethylbenzyl)-4-nonylphenol], 4,4'-methylenebis-(6-tert.-butyl-2-methylphenol), 1,1-bis-(5-tert.-butyl-4-hydroxy-2-methylphenyl)-butane, 2,6-di-(3-tert.-butyl-5-methyl-2-hydroxybenzyl)-4-methylphenol, 1,1,3-tris-(5-tert.-butyl-4-hydroxy-2-methylphenyl)-3-n-dodecylmercaptobutane, ethylene glycol bis-[3,3'-bis-(3'-tert.-butyl-4'-hydroxyphenyl)-butyrate], di-(3-tert.-butyl-4-hydroxy-5-methylphenyl)-dicyclopentadiene and di-[2-(3'-tert.-butyl-2'-hydroxy-5'-methylbenzyl)-6-tert.-butyl-4-methylphenyl]terephthalate.

5. Benzyl compounds 1,3,5-Tri-(3,5-di-tert.-butyl-4-hydroxybenzyl)-2,4,6-trimethylbenzene, di-(3,5-di-tert.-butyl-4-hydroxybenzyl sulfide, bis-(4-tert.-butyl-3-hydroxy-2,6-dimethylbenzyl)dithiol terephthalate, 1,3,5-tris-(3,5-di-tert.-butyl-4-hydroxybenzyl) isocyanurate, 1,3,5-tris-(4-tert.-butyl-3-hydroxy-2,6-dimethylbenzyl) isocyanurate, dioctadecyl 3,5-di-tert.-butyl-4-hydroxybenzylphosphonate and the calcium salt of monoethyl 3,5-di-tert.-butyl-4-hydroxybenzylphosphonate.

6. Acylaminophenols

4-Hydroxylauranilide, 4-hydroxystearanilide, 2,4-bisoctylmercapto-6-(3,5-di-tert.-butyl-4-hydroxyanilino)-s-triazine and octyl N-(3,5-di-tert.-butyl-4-hydroxyphenyl)-carbamate.

7. Esters of β-(3,5-di-tert.-butyl-4-hydroxyphenyl)-propionic acid with monohydric or polyhydric alcohols, for example with:

| | |
|---|---|
| methanol | diethylene-glycol |
| octadecanol | triethylene-glycol |
| 1,6-hexane-diol | pentaerythritol |
| neopentylglycol | tris-hydroxyethyl isocyanurate |
| thiodiethylene-glycol | di-hydroxyethyl-oxamide |

8. Esters of β-(5-tert.-butyl-4-hydroxy-3-methylphenyl)propionic acid with monohydric or polyhydric alcohols, for example with:

| | |
|---|---|
| methanol | diethylene-glycol |
| octadecanol | triethylene-glycol |
| 1,6-hexane-diol | pentaerythritol |
| neopentylglycol | tris-hydroxyethyl isocyanurate |
| thiodiethylene-glycol | di-hydroxyethyl-oxamide |

9. Amides of β-(3,5-di-tert.-butyl-4-hydroxyphenyl)-propionic acid, for example N,N'-di-(5,5-di-tert.-butyl-4-hydroxyphenylpropionyl)-hexamethylenediamine, N,N'-di-(5,5-di-tert.-butyl-4-hydroxyphenylpropionyl)-trimethylenediamine and N,N'-di-(3,5-di-tert.-butyl-4-hydroxyphenylpropionyl)-hydrazine.

Examples of amine antioxidants

N,N'-Di-isopropyl-p-phenylenediamine, N,N'-di-sec.-butyl-p-phenylenediamine, N,N'-bis-(1,4-dimethylpentyl)-p-phenylenediamine, N,N'-bis-(1-ethyl-3-methylpentyl)-p-phenylenediamine, N,N'-bis-(1-methylheptyl)-p-phenylenediamine, N,N'-dicyclohexyl-p-phenylenediamine, N,N'-diphenyl-p-phenylenediamine, N,N'-di-(naphthyl-2-)-p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfonamido)-diphenylamine, N,N'-dimethyl-N,N'-di-sec.-butyl-p-phenylenediamine, diphenylamine, 4-isopropoxydiphenylamine, N-phenyl-1-naphthylamine, N-phenyl-2-naphthylamine, octylated diphenylamine, 4-n-butylaminophenol, 4-butyrylaminophenol, 4-nonanoylaminophenol, 4-dodecanoylaminophenol, 4-octadecanoylaminophenol, di-(4-methoxyphenyl)-amine, 2,6-di-tert.-butyl-4-dimethylaminomethylphenol, 2,4'-diaminodiphenylmethane, 4,4'-diaminodiphenylmethane, N,N,N,N'-tetramethyl-4,4'-diaminodiphenylmethane, 1,2-di-(phenylamino)-ethane, 1,2-di-[(2-methylphenyl)-amino]-ethane, 1,3-di-(phenylamino)propane, (o-tolyl)-biguanide and di-[4-(1',3'-dimethylbutyl)phenyl]-amine.

The following are examples of metal passivators: examples for copper:

benztriazole, tetrahydrobenztriazole, 2-mercaptobenzthiazole, 2,5-dimercaptothiadiazole, salicylidenepropylenediamine and salts of salicylaminoguanidine.

The following are examples of rust inhibitors:

(a) Organic acids and esters, metal salts and anhydrides thereof, for example: N-oleoylsarcosine, sorbitan monooleate, lead naphthenate, dodecenylsuccinic anhydride, alkenylsuccinic half-esters and 4-nonylphenoxyacetic acid.

(b) Nitrogen-containing compounds, for example:

I. Primary, secondary or tertiary aliphatic or cycloaliphatic amines and amine salts of organic and inorganic acids, for example oil-soluble alkylammonium carboxylates.

II. Heterocyclic compounds, for example: substituted imidazolines and oxazolines.

(c) Phosphorus-containing compounds, for example: amine salts of phosphoric acid partial esters.

(d) Sulfur-containing compounds, for example: barium dinonylnaphthalenesulfonates and calcium petroleumsulfonates.

The following are examples of viscosity index improvers:

Polymethacrylates, vinylpyrrolidone/methacrylate copolymers, polybutenes, olefine copolymers and styrene/acrylate copolymers.

The following are examples of pour-point depressants:

Polymethacrylates and alkylated naphthalene derivatives.

The following are examples of dispersing agents/surfactants:

Polybutenylsuccinimides, polybutenylphosphonic acid derivatives and basic magnesium sulfonates and phenates, calcium sulfonates and phenates and barium sulfonates and phenates.

The following are examples of anti-wear additives:

Compounds containing sulfur and/or phosphorus and/or halogen, such as sulfurised vegetable oils, zinc dialkyldithiophosphates, tritolyl phosphate, chlorinated paraffins and alkyl and aryl disulfides.

The examples which follow illustrate a few specific compositions in greater detail; the latter consist of the solvent-extracted, petroleum-based base oils ISO VG 22/32 (base oil BB) and ISO VG 32 (base oil AA), which are characterised more precisely in Table 1, and, on the other hand, of specific proportions of additives.

TABLE 1

| | Description of the base oils | | | | | | |
|---|---|---|---|---|---|---|---|
| | Carbon distribution (IR) | | | | Viscosity ($mm^2$/sec.) at | | |
| Base oil | CA % | CP % | CN % | Sulfur % | 40° C. | 100° C. | VI |
| BB | 6.5 | 72.0 | 21.5 | 0.54 | 26.2 | 4.79 | 102 |
| AA | 10.5 | 66.0 | 23.5 | 0.32 | 29.4 | 5.20 | 107 |

EXAMPLE 1

The oil oxidation test which follows is used to demonstrate the synergism achieved by adding a proportion of 1-[di-(2-ethylhexyl)-aminomethyl]-benztriazole which is methylated in the benzene ring in the 4-position and/or 5-position to a lubricant containing a specific proportion of an antioxidant, compared with a lubricant containing only an antioxidant.

Oil oxidation test, standard version as specified in A5TM D 2272, IP 229 (Rotary Bomb Oxidation Test)

An oil sample consisting of 50 ml of base oil BB (cf. Table 1) to which 0.25 g of stabiliser has been added is oxidised, in an oxygen atmosphere, in a glass vessel, together with 5 ml of distilled water and a brightly polished, catalytically active Cu spiral which has been washed with petroleum ether.

The glass vessel is located in a stainless steel bomb equipped with a manometer. The bomb rotates on its axis at 100 r.p.m. at an angle of 30° to the horizontal in an oil bath at 150° C. Initially, before heating up, the oxygen pressure is 620 kPa; it rises to just under 1500 kPa and remains contant until oxidation sets in. The test is complete when the pressure has fallen by 172 kPa. The time is recorded in minutes. Long times are a sign of good effectiveness of the stabiliser.

The amounts of stabiliser used in each case can be seen from Table 2 below.

In order to make the following table easier to follow, numbers are allocated to the names of the additives:

1. No additive
2. 1-[(Di-(2-ethylhexyl))-aminomethyl]-benztriazole which is methylated in the benzene ring in the 4-position and/or 5-position.
3. Pentaerythrityl tetrakis-[3-(3,5-di-tert.-butyl-4-hydroxyphenyl)-propionate].
4. Isooctyl 3,5-di-tert.-butyl-4-hydroxybenzylmercaptoacetate.
5. A mixture of 40% of additive No. 3, 30% of methyl (2,5-di-tert.-butyl-4-hydroxyphenyl)-propionate and 30% of o-tert.-butylphenol.
6. 2,6-Di-tert.-butyl-4-methylphenol.
7. 4,4'-Methylenebis-(2,6-di-tert.-butylphenol).
8. Tert.-octylated N-phenyl-1-naphthylamine.
9. A mixture of monoalkylated and dialkylated tert.-butyl-diphenylamines and tert.-octyldiphenylamines.

TABLE 2

| | Lubricant formulation containing | |
|---|---|---|
| Additive No. | 0.25% by weight of antioxidant $t_1$ minutes until pressure fall by 172 kPa | 0.20% by weight of antioxidant (No. 3-9) and 0.05% by weight of additive (No. 2) $t_2$ minutes until pressure fall by 172 kPa |
| 1 | 25 | |
| 2 | 124 | |
| 3 | 101 | 319 |
| 4 | 83 | 240 |
| 5 | 109 | 308 |
| 6 | 129 | 269 |
| 7 | 73 | 260 |
| 8 | 514 | 609 |
| 9 | 254 | 502 |

As can be seen from Table 2, the synergistic effect achieved by adding 1[di-(2-ethylhexyl)-aminomethyl]-benztriazole which is methylated in the 4-position and/or 5-position in the benzene ring (additive no. 2) to a lubricant formulation containing an antioxidant (additive no. 3-9) is significant.

EXAMPLE 2

In order to investigate the compatibility, with amine phosphates of the formula I, of 1-[di-(2-ethylhexyl-)aminomethyl]-benztriazole which is substituted by methyl in the benzene ring in the 4-position and/or 5-position, storage tests are carried out at room temperature with certain stabiliser systems, the clarity of the solution being a criterion of good compatibility.

In order to quote the additives in a brief form in the demonstration formulations, they will be identified beforehand as follows:

$X_1$ ≙ A mixture consisting of 40% of pentaerythrityl tetrakis-[3-(3,5-tert.-butyl-4-hydroxyphenyl)-propionate], 30% of methyl (2,5-di-tert.-butyl-4-hydroxyphenyl)propionate and 30% of o-tert.-butylphenol.

$X_2$ ≙ A mixture of monoalkylated and dialkylated tert.-butyldiphenylamines/tert.-octyldiphenylamines.

$X_3$ ≙ 1-[Di-(2-ethylhexyl)-aminomethyl]-benztriazole which is substituted by methyl in the benzene ring in the 4-position and/or 5-position.

$X_4$ ≙ The diisotridecylamine salt of hexyl phosphate.

The demonstration formulations can now be identified as follows:

TABLE 3

| Demonstration formulation | Base oil | $X_1$ % by weight | $X_2$ % by weight | $X_3$ % by weight | $X_4$ % by weight |
|---|---|---|---|---|---|
| I | BB | — | 0.250 | 0.030 | 0.100 |
| II | BB | 0.125 | 0.125 | 0.030 | 0.100 |
| III | BB | 0.250 | — | 0.030 | 0.100 |

As can be seen from Table 4, stabiliser systems containing the above compound are very compatible for a prolonged period with amine phosphates of the formula I.

TABLE 4

| | Compatibility with amine phosphate $X_4$ | | |
|---|---|---|---|
| | Appearance | | |
| Example No. | after 1 day | after 20 days | after 250 days |
| I-III | clear solution | | |

What is claimed is:

1. A stabilizer system which contains (a) 1-[di-(2-ethylhexyl)-aminomethyl[-benztriazole which is substituted by methyl in the 4-position and/or 5-position in the benzene ring, and (b) at least one antioxidant selected from the group consisting of pentaerythrityl tetrakis-[3-(3,5-di-tert.-butyl-4-hydroxyphenyl)-propionate], isooctyl 3,5-di-tert.-butyl-4-hydroxybenzylmercaptoacetate, o-tert.-butylphenol, 2,6-di-tert.-butyl-4-methylphenol, 4,4'-methylenebis-(2,6-di-tert.-butylphenol), tert.-octylated N-phenyl-1-naphthylamine, and a mixture of monoalkylated and dialkylated tert.-butyldiphenyl-amines/tert.-octyldiphenylamines, where the weight ratio between component (a) and component (b) is 1:2 to 1:10.

2. A stabilizer system according to claim 1 which additionally contains (c) a compound of formula I

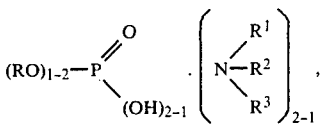

(I)

in which $R^1$, $R^2$ and $R^3$ are identical or different and $R^1$, $R^2$ and $R^3$ are each hydrogen or $C_1$–$C_{18}$-alkyl, $C_{16}$–$C_{18}$-alkenyl methyl, phenyl, naphthyl or $C_5$–$C_6$-cycloalkyl and R is $C_4$–$C_{12}$-alkyl, where the weight ratio between component (c) and components (a) plus (b) is 1:0.5 to 1:4.

3. A lubricant composition which comprises (a) a mineral or snythetic lubricating oil, fluid or grease, (b) 0.01 to 5% by weight, based on the total weight of the composition, of an antioxidant according to claim 1 , and (c) 0.001 to 5% by weight, based on the total weight of the composition, of the 4-(5-)-methyl-1-[di-(2-ethylhexyl)aminomethyl]-benzotriazole according to claim 1.

4. A composition according to claim 3 wherein, based on the total composition, 0.1 to 2% by weight of antioxidant; and 0.01 to 1% by weight of 4-(5-)-methyl-1-[di-((2-ethylhexyl)aminomethyl]-benzotriazole are present.

5. A lubricant composition according to claim 3 which additionally contains (d) 0.01 to 2% by weight, based on the total composition, of a compound of formula I

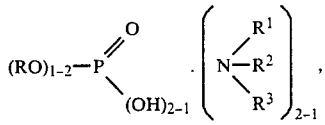

(I)

in which $R^1$, $R^2$ and $R^3$ are identical or different and $R^1$, $R^2$ and $R^3$ are each hydrogen or $C_1$–$C_{18}$-alkyl, $C_{16}$–$C_{18}$-alkenyl methyl, phenyl, naphthyl or $C_5$–$C_6$-cycloalkyl and R is $C_4$–$C_{12}$-alkyl.

6. A method of stabilising lubricants by adding to them an effective amount of the stabiliser system according to claim 1.

7. A method of stabilising lubricants by adding to them an effective amount of the stabiliser system according to claim 2.

* * * * *